US007307611B2

(12) United States Patent
Chien et al.

(10) Patent No.: US 7,307,611 B2
(45) Date of Patent: Dec. 11, 2007

(54) DRIVING METHOD FOR LCD PANEL

(75) Inventors: Liang-Chen Chien, Chu-Pei (TW); Cheng-Jung Chen, Maio-Li Hsien (TW); Chang-Cheng Lin, Taipei (TW)

(73) Assignee: VastView Technology Inc., Hsinchu (TW)

( * ) Notice: Subject to any disclaimer, the term of this patent is extended or adjusted under 35 U.S.C. 154(b) by 612 days.

(21) Appl. No.: 10/889,265

(22) Filed: Jul. 10, 2004

(65) Prior Publication Data

US 2006/0007081 A1 Jan. 12, 2006

(51) Int. Cl.
*G09G 3/36* (2006.01)

(52) U.S. Cl. ..... 345/94; 345/99; 345/100; 345/102

(58) Field of Classification Search ..... 345/76, 345/87–88, 98–104, 204–214, 403; 315/248, 315/291, 307

See application file for complete search history.

(56) References Cited

U.S. PATENT DOCUMENTS 7,006,069 B2 * 2/2006 Tanaka et al. ..... 345/98

* cited by examiner

*Primary Examiner*—Alexander Eisen
*Assistant Examiner*—Christopher E Leiby

(57) ABSTRACT

A driving method for LCD panels is disclosed, wherein the driver circuit includes multiple data line drivers and at least two gate line drivers, and the first gate line driver produces a normal image with sequential line scanning starting from the beginning of a frame, and the second gate line driver produces a dimmed image starting from a predetermined number of lines below at the same time to emulate one full sweep across a CRT. Therefore, a dimmed image is inserted into every digitized image, where a dimmed image is defined to be a digitized image with each pixel having a fraction 1/N of the original pixel value. The LCD panel drive using this driving method achieves performance closer to the impulse approach used in CRT displays, and the flickering phenomenon can be significantly rectified.

5 Claims, 5 Drawing Sheets

DRIVING METHOD FOR LCD PANEL

BACKGROUND OF THE INVENTION

1. Field of the Invention

The present invention relates to a driving method for liquid crystal display (LCD) panels, and in particular to a method for driving LCD panels by alternately displaying a dimmed image and a normal image in a single frame so that image display performance on LCD panels can be brought closer to the impulse approach used in cathode ray tube (CRT) displays, and the flickering phenomenon can be significantly rectified.

2. The Related Art

One effective method of improving the video display performance of and correcting the usual after-image phenomenon on LCD panels is to use pseudo-impulse drive (PID) technology, which enables the digitized image to more closely approach the performance of the impulse-emission of the CRT displays. Referring to FIGS. 1A-1C, the current method of pseudo impulse drive employs alternate display of a normal image 10 and an all-black image 20 to emulate the impulse emission of the CRT.

FIG. 5 shows an LCD panel 34 having multiple data lines connected to multiple data line drivers 31 and multiple gate lines connected to two gate line drivers 32, 33 for displaying a digitized image. A pixel in the digitized image is displayed in an overlapping area between a data line and a gate line. A selection rule is defined for selection from at least two gate line drivers of the PID, one of which is selected as the first gate line driver and the other as the second gate line driver so that the first and second gate line drivers alternately output a normal image 10 and an all-black image 20 in a single frame.

The first gate line driver starts to scan from the first line to the eleventh line one line at a time sequentially downward, as shown in FIG. 1A, to produce a normal image 10, and the second gate line driver starts to scan from the 241st line down to the 251st line sequentially downward, as shown in FIG. 1B, to produce an all-black image 20 until the bottom is reached. Thereafter, the first gate line driver then continues with the normal image 10 from the 241st line, and the second gate line driver then continues with the all-black image 20 from the 1st line as shown in FIG. 1C, and the line scanning proceeds in such a manner until all gate lines connected to the first and second gate line drivers are used, thus emulating a full sweep across the display screen.

As shown in FIG. 1C, before part of the normal image 10 is displayed, the gate lines starting from the 241st line were first used to display part of an all-black image 20 as shown in FIG. 1A, so the drive voltage of all pixels on the 241st line and following lines has been restored to non-emission state after the all-black image 20. Therefore, when the first gate line driver starts the line scanning from the 241st line to produce part of the normal image 10, the pixels of the 241st line and lines following undergo a voltage change very much like the impulse emission of the CRT, to more closely emulate the impulse drive of the CRT.

However, if the refresh rate of the LCD panel is only 60 Hz, using the above PID method to drive an LCD panel, the high-speed switching between all-black images 20 and normal images 10 could easily produce flickering phenomenon to the human eyes. Further, the all-black image 20 could be inserted before the normal image 10, thus affecting the brightness of the LCD panel by as much as 50%. Therefore, if the conventional PID method is used to drive an LCD panel, it is necessary to use a backlight source of higher luminescent efficiency.

SUMMARY OF THE INVENTION

The primary objective of the present invention is to provide a driving method for LCD panels that is able to avoid the flickering of the digitized image as compared with the prior art method.

The secondary objective of the invention is to provide a driving method for LCD panels that is able to avoid any degradation of the brightness of the LCD as compared with the prior art PID method, making it unnecessary to use a backlight source of higher luminescent efficiency.

To this end, the driver circuit in accordance with the present invention employs multiple data line drivers and at least two gate line drivers, where one of the two gate line drivers is to be the first gate line driver, and the other one to be the second gate line driver, wherein the first gate line driver is positioned to start line scanning from the beginning of a frame one line at a time and sequentially downward for a frame of image to produce a normal image, and the second gate line driver is positioned to scan from a number of predetermined lines below sequentially downward to produce a dimmed image in the same frame until the bottom of the frame. The second gate line driver is then to continue with the dimmed image from the beginning of the frame and the first gate line driver is to continue with the normal image downward, and the line scanning proceeds in such a manner until all gate lines connected by the first and second gate line drivers are used, thus emulating one full sweep across the display. When one line of the normal image in a single frame is scanned, a line of the dimmed image is also scanned simultaneously, where the dimmed image is defined to be a digitized image in the current frame with each pixel having only 1/N of the original pixel value. In other words, the dimmed image has pixel values 1/N of the pixel values of the normal image before the dimmed image is scanned.

The present invention will become more obvious from the following description when taken in conjunction with the accompanying drawings, which show, for purposes of illustration only, several embodiments in accordance with the present invention.

DETAILED DESCRIPTION OF THE PREFERRED EMBODIMENT

Figure 1A:
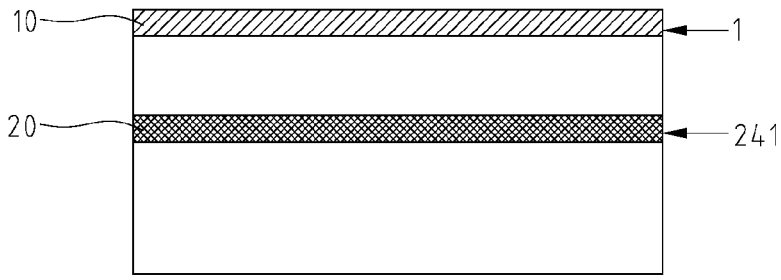
FIGS. 1A-1C depict the conventional method of driving LCD panels with Pseudo Impulse Drive.
Figure 1B:
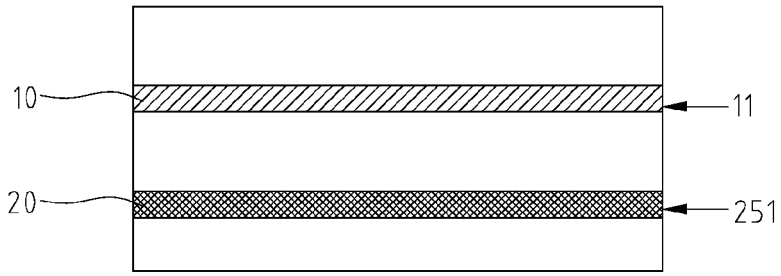
Figure 1C:
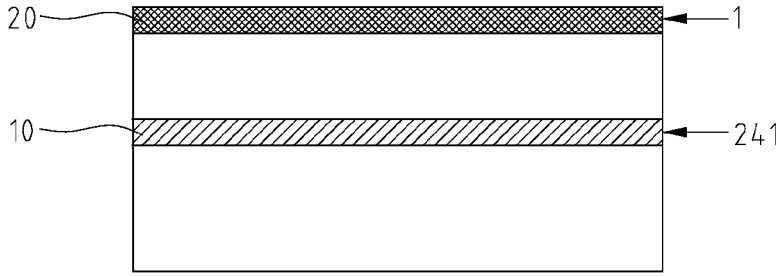
Figure 2A:
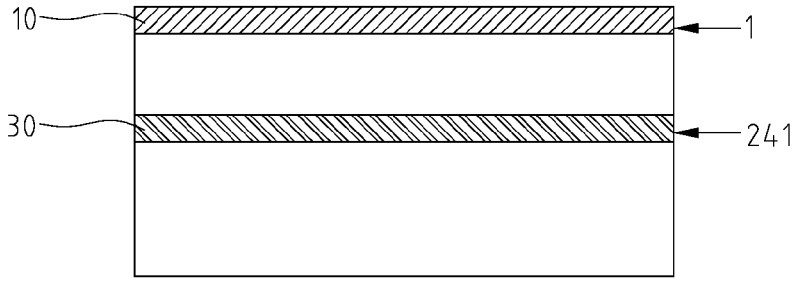
FIGS. 2A-2C depict the driving method of the present invention to emulate impulse-emission of the CRT.
Figure 2B:
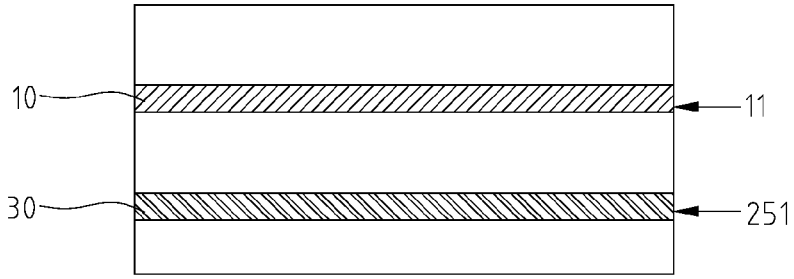
Figure 2C:
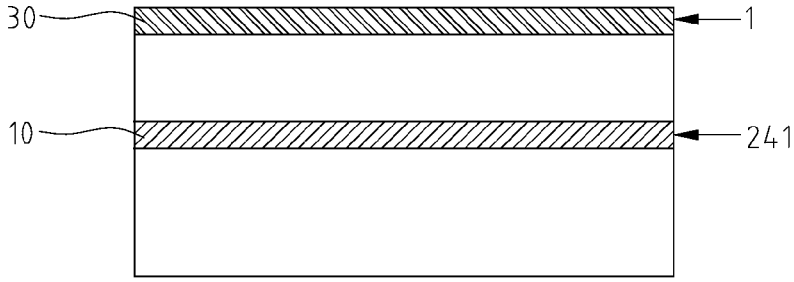

The driving method for LCD panels in accordance with the present invention is illustrated through FIGS. 2A-2C in which the all-black image 20 shown in FIGS. 1A-1C is replaced by a dimmed image 30, where a dimmed image 30 is defined to be a digitized image being displayed in a single frame with each pixel having 1/N of the original pixel value and N is a positive integer. Although other components of the driver circuit are similar to those currently used to implement pseudo impulse drive, the brightness and flickering phenomena are improved significantly with the method of the invention.

Specifically, to display a dimmed image 30 starting from the 1st line as shown in FIG. 2C, the pixel value of a dimmed image 30 in accordance with the invention needs to be derived from the pixel value of the normal image 10 also starting from the 1st line as shown in FIG. 2A by multiplying the original pixel value by a fraction 1/N, where N is a positive integer. If the value of N gets larger, the dimmed image 30 will come closer to the all-black image 20; conversely, if the value of N becomes smaller, the dimmed image 30 will resemble the LCD display using the hold circuit. Therefore, it is necessary to set the N value appropriately so as to be able to produce LCD display performance better than that of using a hold circuit, while the flickering and brightness phenomena can be controlled without using the all-black image 20.

Based on a given selection rule, the gate line driver that works with the data line driver to output the drive voltage for a normal image in a single frame is to be a first gate line driver, whereas the gate line driver that works with the data line driver to output the drive voltage for a dimmed image in the current frame is to be a second gate line driver.

When a drive voltage is asserted on the data lines by the data line drivers 70, the first gate line driver connected to the corresponding gate lines is to produce a normal image 10 of a single frame on the LCD panel by scanning the gate lines, and the second gate line driver is to produce a dimmed image 30 in the current frame by scanning the same number of gate lines.

If the resolution of an LCD panel is given to be 640×480, the first gate line driver produces a normal image 10 starting from the 1st line downward as shown in FIG. 2A, and the second line driver simultaneously inserts a dimmed image 30 starting from the 241st line downward in the current frame as shown in FIG. 2B. Thereafter, the first and second gate line drivers scan the positions of each other. The second gate line driver continues with the dimmed image 30 up from the 1st line sequentially downward, as shown in FIG. 2C, and the first gate line driver continues with the normal image 10 down from the 241st line sequentially downward, wherein when one line of the normal image 10 is being scanned on one part of the frame, a line of the dimmed image 30 is also scanned simultaneously on another part of the frame; and the line scanning proceeds in such a manner until all the gate lines connected by the first and second gate line drivers are used to produce the normal image 10 and the dimmed image 30, thus emulating one full sweep across the display screen.

From the foregoing description, it is apparent that the present invention is related to a driving method for LCD panels that is able to use the dimmed image 30 to replace the all-black image 20 of the prior art. The main advantage is that the dimmed image 30 can be obtained from appropriate modulation of the original digitized image by multiplying the pixel value of the digitized image by a fraction 1/N, without having to produce the all-black image 20. Also, this method can avoid the usual flickering phenomenon and the degradation of brightness associated with the conventional PID. Therefore, it is unnecessary to use backlight source with higher luminescent efficiency and the driver costs can thus be lowered considerably.

Figure 3:
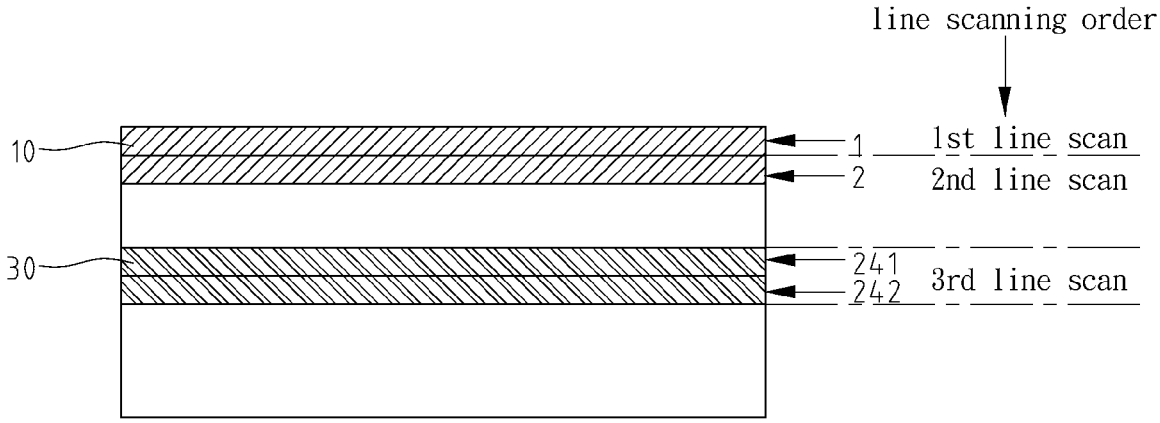
FIG. 3 is another variation of the above driving method.

Referring to FIG. 3, the diagram depicts another variation of the invention, wherein the driving method is different from the previous example in that two lines are scanned at one time by the gate line driver, as compared with the previous example illustrated in FIGS. 2A-2C. The first gate line driver is to produce a normal image 10 from the 1st line one line at a time for two scan lines consecutively, as shown in FIG. 3; then, the second gate line driver is to produce a dimmed image 30 by scanning the 241st and 242nd lines both at the same time consecutively. In other words, the order of line scanning staffs with the 1st line, then the 2nd line, and then the 241st and 242nd lines, and subsequently the line scanning proceeds in the same manner to finish the normal image 10 and the dimmed image 30 to be displayed on the LCD panel.

When compared with FIG. 2A, if two lines are scanned at one time, starting with the pair of 241st and 242nd lines, to produce the dimmed image 30, it is possible to use three vertical clock signals in this case to finish scanning the 1st line, the 2nd line, the 241st and 242nd lines, whereas in the previous example shown in FIG. 2A, four vertical clock signals are required. Theoretically, if the number of scan lines at one time is increased, the required clock signals can be reduced. It shall be noted that the maximum number of scan lines at one time shall be no more than the fixed number of gate lines connected to the gate line drivers, and if the number of scan lines at one time is increased to match the fixed number of gate lines, the required number of clock signals will come close to a conventional LCD.

Figure 4A:
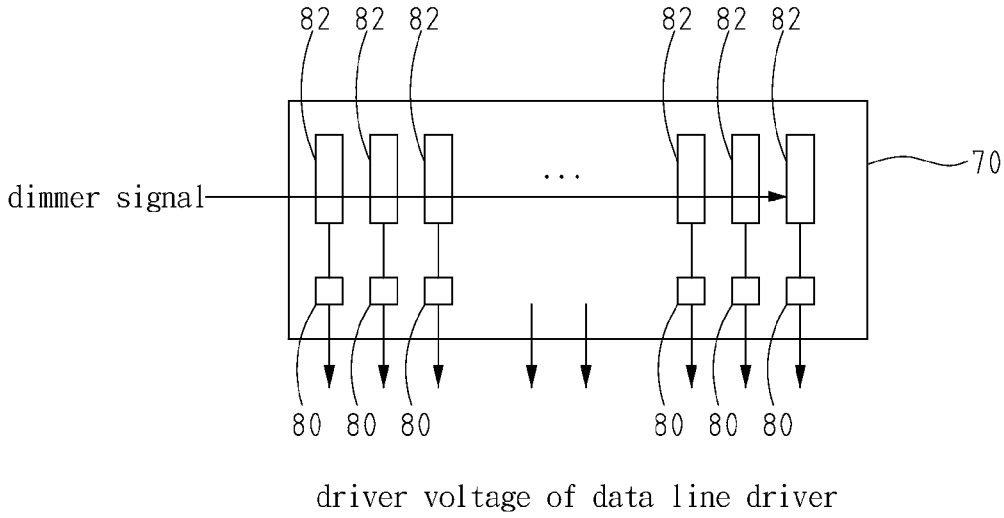
FIGS. 4A-4B illustrate two examples using a dimmer signal in the data line driver.
Figure 4B:
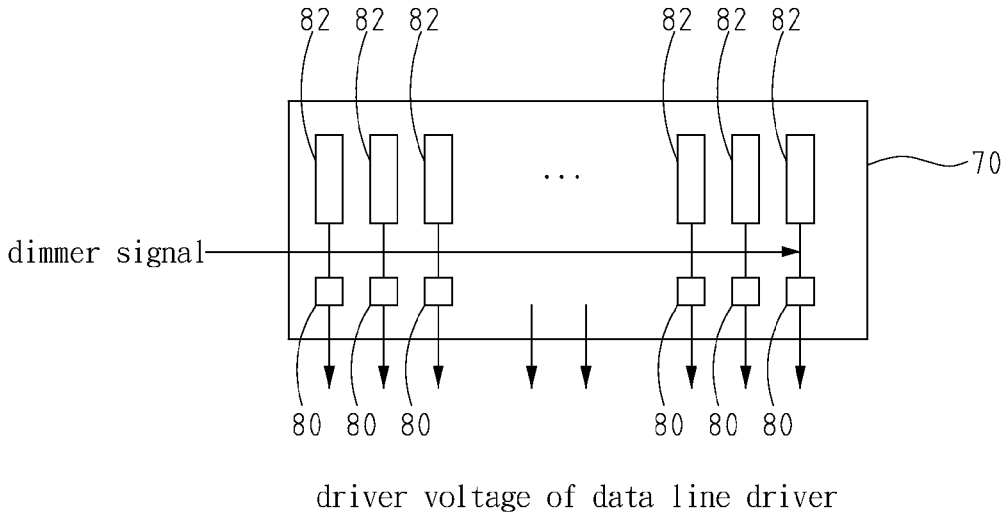
Figure 5:
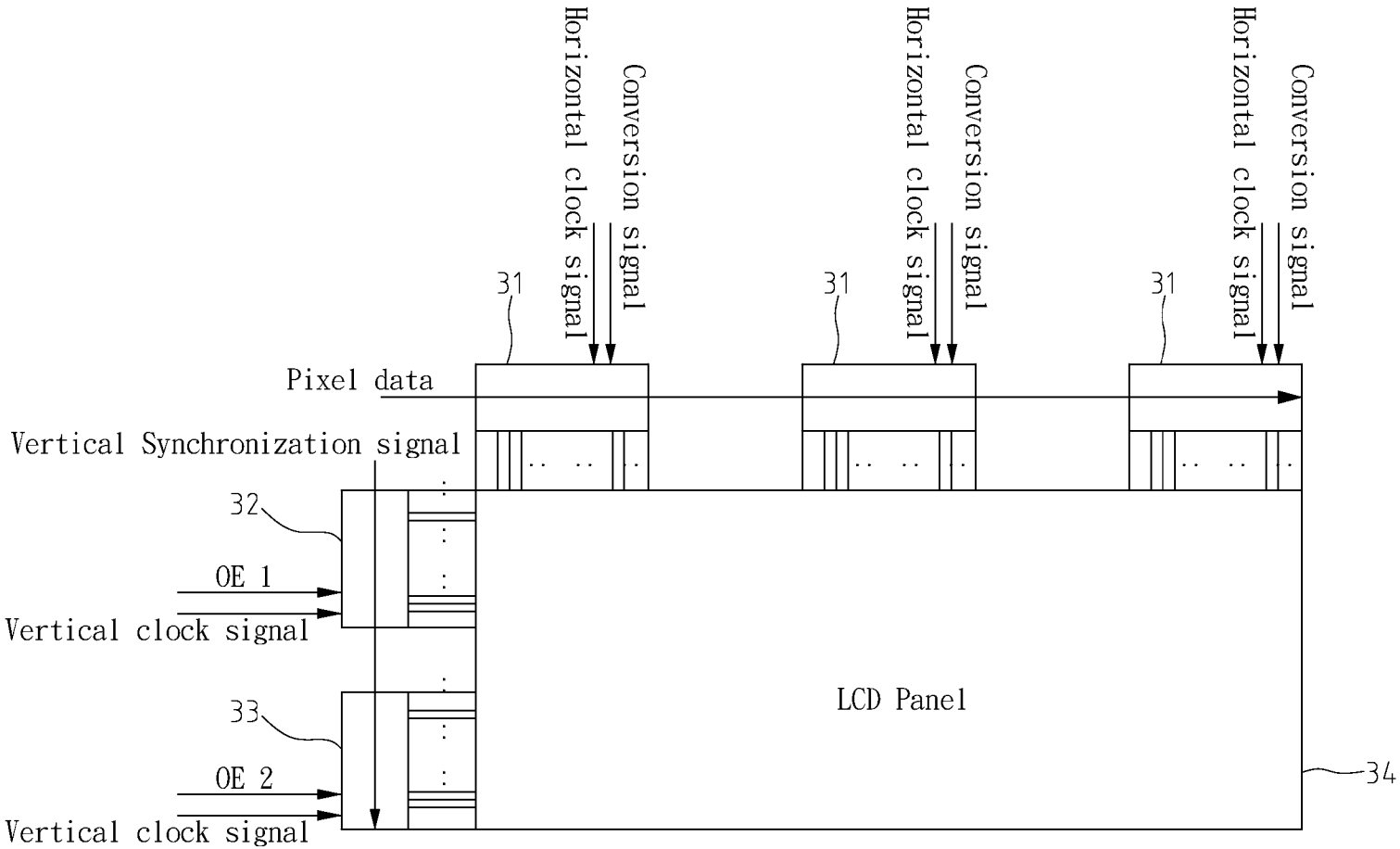
FIG. 5 ( Prior Art )
FIG. 5 illustrates an LCD panel having multiple data lines connected to multiple data line drivers and multiple gate lines connected to two gate line drivers for displaying a digitized image.

Referring to FIGS. 4A-4B, a dimmer signal is introduced in the data line driver. A conventional data line driver 70 includes several digital-to-analog converters (DACs) 80 and data registers 82. The resolution of an LCD panel determines the number of data line drivers 70 for connecting the required number of data lines and the same requirements for DACs 80 and data registers 82.

According to the present invention, the driving method is to insert a dimmed image 30 for every normal image 20 created in a single frame, so the line scanning frequency of the data line driver 70 needs to be twice that of the conventional data line driver, and the data channel width also needs to be increased for accommodating the normal image 10 and the dimmed image 30. However, increased scanning frequency will generate undesirable electromagnetic interference (EMI). The present solution is to connect the data line driver 70 to a dimmer control line so that when a dimmer signal is received, the digitized image temporarily saved in the data registers will be modulated to produce the required dimmed image 30 so as to avoid the increase of line scanning frequency for the data line driver 70.

In one implementation, as shown in FIG. 4A, the dimmer control line is connected to the data registers 82. When the data line driver 70 intends to produce the drive voltage for a dimmed image 30, a dimmer signal is issued to the data registers 82 of the data line drivers 70 so that the digitized image temporarily saved in the data registers 82 is modulated. As a result, the pixel value of the digitized image is changed to a fraction 1/N of the original pixel value. Therefore, when the modulated digital signals are eventually passed to the DACs 80, the drive voltage output by the data line driver 70 is able to match the required dimmed image 30, and it is not necessary to produce or save the dimmed image 30 in the data registers 82.

In another implementation, as shown by FIG. 4B, the dimmer control line is connected between the data registers 82 and the DACs 80. When the data line driver 70 intends to output the drive voltage for a dimmed image 30, all data registers 82 and DACs 80 receive a dimmer signal, and these components will cause a certain change in the digital signals to be sent to the DACs 80 SO that the pixel value of the digitized image is to be changed to 1/N of the original pixel value. After the modulated digital signals are passed to the DACs 80, the drive voltage output by the data line drivers is to match the required dimmed image 30. Therefore, the introduction of the dimmer signal makes it unnecessary to first save the dimmed image 30 in data registers 82 according to these two implementations.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A driving method for LCD panels having multiple data lines connected to multiple data line drivers and multiple gate lines connected to at least first and second gate line drivers for displaying a digitized image comprising a plurality of pixels with each pixel being positioned in an overlapping area between a data line and a gate line, said driving method comprising the steps of:

producing a normal image by sequentially scanning downward from a starting line to an ending line of a single frame cyclically using said first gate line driver to drive said multiple gate lines; and producing a dimmed image by sequentially scanning downward from a specific line of said single frame to said ending line and then sequentially scanning from said starting line to said ending line cyclically by using said second gate line driver to drive said multiple gate lines, said specific line being positioned at a predetermined number of lines below said starting line;

wherein said normal image and said dimmed image are produced simultaneously frame after frame, and each pixel in said dimmed image has a pixel value equal to 1/N of the pixel value of a corresponding pixel in said normal image before said dimmed image is produced, and N is a positive number.

2. The driving method as claimed in claim 1, wherein the number N is a positive integer.

3. The driving method as claimed in claim 1, wherein said first gate line driver scans a number of consecutive lines simultaneously in a single frame for producing said normal image and said second gate line driver scans the same number of consecutive lines simultaneously in a single frame for producing said dimmed image.

4. The driving method as claimed in claim 3, wherein said predetermined number of lines include more lines than said number of consecutive lines.

5. The driving method as claimed in claim 1, wherein a dimmer control line is used to send a dimmer signal to said data line drivers for controlling data registers in said data line drivers to produce said dimmed image.

* * * * *